US005558021A

United States Patent [19]

Erhard et al.

[11] Patent Number: 5,558,021

[45] Date of Patent: Sep. 24, 1996

[54] PRINTING DEVICE FOR PRINTING PLASTIC CARDS

[75] Inventors: Helmut Erhard, Volkach; Georg Schneider, Würzburg, both of Germany

[73] Assignee: Metronic-Geratebau GmbH & Co., Veitshochheim, Germany

[21] Appl. No.: 521,580

[22] Filed: Aug. 30, 1995

[30] Foreign Application Priority Data

Aug. 30, 1994 [DE] Germany ..... 44 30 801.9

[51] Int. Cl.[6] ..... B41F 13/24

[52] U.S. Cl. ..... 101/232; 101/349

[58] Field of Search ..... 101/118, 216, 101/219, 232, 348, 349, 350, 351

[56] References Cited

U.S. PATENT DOCUMENTS

| | | | |
|---|---|---|---|
| 3,074,532 | 1/1963 | Balaz | 101/232 |
| 4,479,431 | 10/1984 | Germann | 101/349 |
| 4,909,149 | 3/1990 | Melcher | 101/232 |
| 5,081,926 | 1/1992 | Rodi | 101/211 |
| 5,134,936 | 8/1992 | John | 101/348 |
| 5,458,059 | 10/1995 | Ishii | 101/232 |
| 5,460,088 | 10/1995 | Heiler et al. | 101/352 |
| 5,481,970 | 1/1996 | Terzi et al. | 101/232 |

*Primary Examiner*—Eugene H. Eickholt
*Attorney, Agent, or Firm*—Jones, Tullar & Cooper, P.C.

[57] ABSTRACT

A printing device for printing plastic cards utilizes a printing and inking unit which is supported in a pivotable frame, in cooperation with a counter-pressure cylinder to print individual cards in one or more streams of cards. The printing and inking unit includes an ink duct, a screen cylinder, an ink transfer cylinder, a printing forme support cylinder and a rubber blanket support cylinder. The pivot frame can be pivoted to separate the rubber blanket support cylinder from the counter-pressure cylinder so that the rubber blankets on both cylinders can be accessed.

11 Claims, 2 Drawing Sheets

PRINTING DEVICE FOR PRINTING PLASTIC CARDS

FIELD OF THE INVENTION

The present invention is directed generally to a printing device for printing plastic cards. More particularly, the present invention is directed to a device for printing individual plastic cards, of the so-called check card format. More specifically, the present invention is directed to a printing device for printing plastic cards which are supplied to the printing device in a stream of individual cards. A counter-pressure cylinder is supported between two spaced lower side frames. A printing and inking unit is pivotably supported above the counter-pressure cylinder. This printing unit can be pivoted up to provide access to the counter-pressure cylinder and to a rubber blanket support cylinder in the printing unit. Individual cards are printed and are then dried and stacked.

DESCRIPTION OF THE PRIOR ART

Plastic cards, used as credit and debit cards are becoming increasingly popular. These cards were once quite plain in appearance and had little or no printing on their surfaces. These cards now are quite likely to be printed with increasingly complex and colorful backgrounds in an effort to differentiate one card from its competition and to attract users of the card. In the past, the printing units used to print these plastic cards have utilized UV printing inks which have been processed in inking and printing units in accordance with the offset method of printing. One limitation of these prior art plastic card printing units is that they have large inking units which have a large ink storage volume. These prior art plastic card offset printing units must be set in accordance with color zones. It has also been necessary in these prior art devices to print the plastic cards while they are arranged in sheet form. Such an arrangement of printing clearly requires a substantial amount of set-up and is apt to be quite wasteful of plastic card sheet blanks and of ink during set-up. In addition, the printed sheets of plastic cards must then be die cut or otherwise separated into individual cards.

It will be apparent that a need exists for a plastic card printer that overcomes these limitations. The printing device for printing plastic cards in accordance with the present invention provides such a device and is a significant improvement in the art.

SUMMARY OF THE INVENTION

It is an object of the present invention to provide a printing device for printing plastic cards.

Another object of the present invention is to provide a device for printing individual plastic cards of the so-called check card format.

A further object of the present invention is to provide a plastic card printing device which will print individual plastic cards.

Yet another object of the present invention is to provide a plastic card printing device without an ink duct-adjusting screw.

Still a further object of the present invention is to provide a plastic card printer for printing in a planographic printing process without dampening agents.

Even yet a further object of the present invention is to provide a printing device for printing plastic cards which is compact and efficient.

As will be described in detail in the description of the preferred embodiment which is presented subsequently, the printing device for printing plastic cards in accordance with the present invention takes individual cards from a stack of cards and supplies these cards, in a stream of cards, to the card printer. This printer utilizes a counter-pressure cylinder, which is supported between spaced lower side frames, and a pivotably supported printing and inking unit. The printing and inking unit includes an ink duct with a doctor blade that supplies ink to a screen ink roller. This ink is transferred by an ink transfer cylinder to a printing forme support cylinder. The printing form support cylinder is, in turn in contact with a rubber blanket support cylinder. The individual plastic cards are printed as they pass through the NIP defined by the rubber blanket support cylinder and the counter-pressure cylinder. The printing and inking unit can be pivoted up and away from the lower support frames to afford access to the counter-pressure cylinder and to the rubber blanket support cylinder. All of the cylinders in the printing device are driven synchronously with each other.

The printing device for printing plastic cards in accordance with the present invention has a number of advantages over the prior art devices. One particular advantage is the great reduction in start up waste which is afforded by the present device. The so-called short inking unit, which does not require duct-adjusting screws and which operates without dampening agents, and which is part of the subject printing device, requires far less adjusting than did prior long inking units operating in the offset method.

It is further possible in accordance with the present invention to utilize a gripper-less counter-pressure cylinder that is provided with a rubber blanket cover. The rubber blanket cover on the counter-pressure cylinder can be easily examined and replaced because the counter-pressure cylinder is easily accessed in spite of the small overall structural size of the subject printing device.

The printing device for printing plastic cards in accordance with the present invention is structured to print individual cards that are supplied to it in a stream of cards. It is not necessary to print entire sheets of cards which must then be die cut or otherwise separated into individual cards. Even though individual cards are printed, it is still possible to maintain high rates of printing productivity since several streams of individual cards can run through the printing device in a plurality of parallel streams. These several streams can also be printed in separate colors, if desired, by dividing the ink duct into several chambers.

The individual plastic cards to be printed are supplied from a stack or stacks of cards to feed sliders or belt conveyors which properly space the cards. The spacing can be accomplished using a card feed device which is driven by the counter-pressure cylinder using a crank mechanism. This insures that the cards are placed in the printing gap between the counter-pressure cylinder and the rubber blanket support cylinder in proper register due to the synchronous operation of the counter-pressure cylinder and the plastic card feed device.

Several of the printing devices for printing plastic cards in accordance with the present invention can be placed one after the other in the direction of card travel. This will allow each plastic card to be printed in a plurality of different colors.

The printing device for printing plastic cards in accordance with the present invention overcomes the limitations of the prior art devices. It is a substantial advance in the art.

BRIEF DESCRIPTION OF THE DRAWINGS

While the novel features of the printing device for printing plastic cards in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
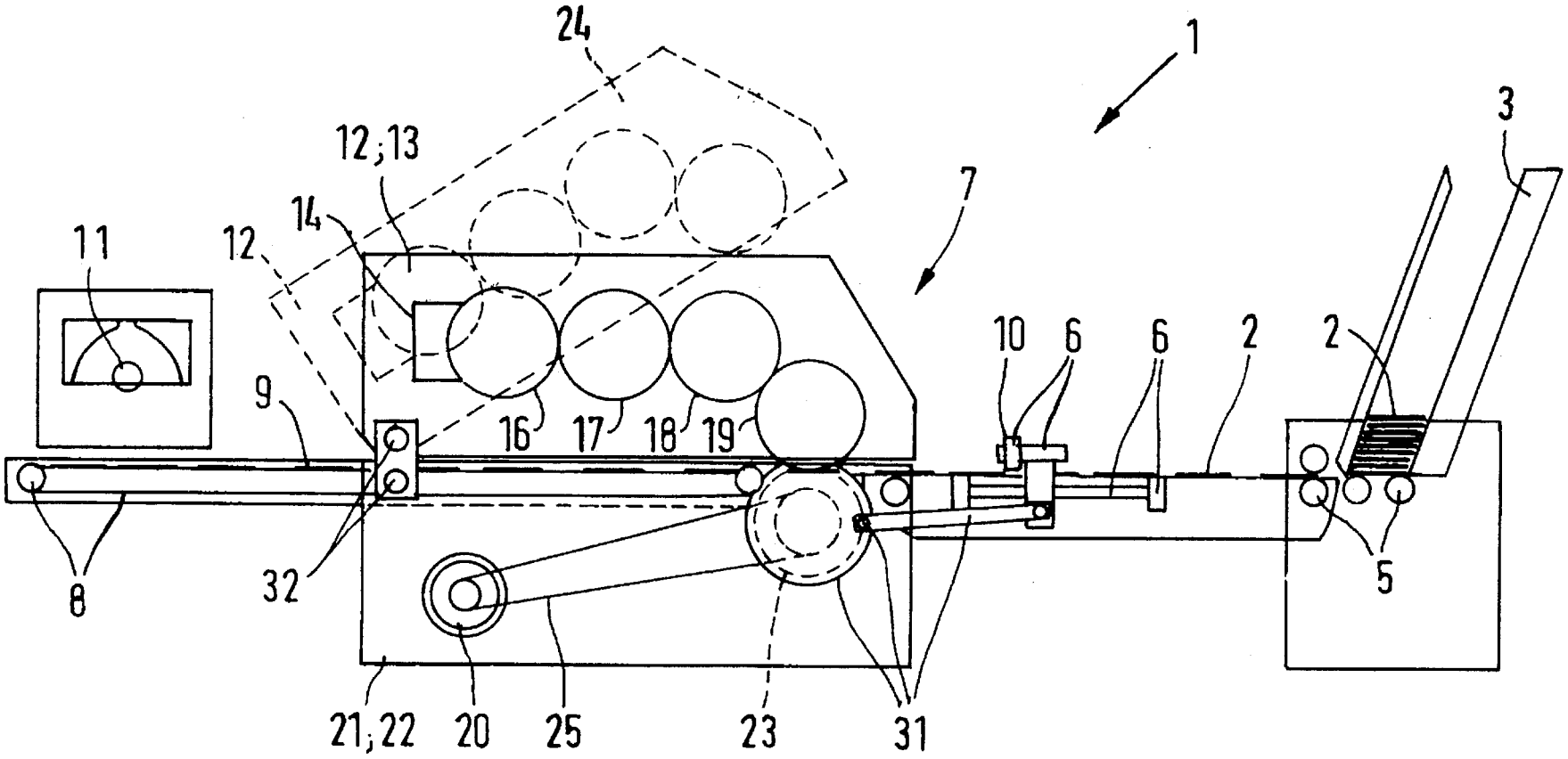
FIG. 1 is a schematic side elevation view of a printing device for printing plastic cards in accordance with the present invention.

Referring initially to FIG. 1, there may be seen a printing device for printing plastic cards in accordance with the present invention. The printing device is usable to print each of a plurality of individual plastic cards 2 which each have a relatively small surface area, and which are typically in a check or credit card format. The individual plastic cards 2 are provided by a separating device 3 to a circumference-registering device and thence to an indexing feed device 6 for the cards 2 to be printed. The cards are then fed to a printing and inking unit 7 where the cards are printed. The now-printed cards 9 are fed by a conveying device 8 from the inking and printing unit 7 to a suitable UV dryer 11. From the UV dryer 11 the printed cards 9 are moved by means of the conveying device 8, which is preferably a conveyor belt, to an exit stacking installation which is not specifically shown in the drawings.

Again referring to FIG. 1, the unprinted cards 2 are taken from the bottom of the stack of cards 2 in the separating device 3 by means of driven separating rollers 5 and are directed to the indexing feed device 6 in a clocked or timed manner. The feed device 6 includes an arrangement of belt conveyers 10 which are driven with a linear speed that is synchronous with the printing speed and onto which the unprinted cards are pushed by the separating rollers of the separating device 3. As may be seen in FIG. 1, the unprinted cards 2 are separated from each other by the separating rollers 5 and the indexing feed device 6. This may be accomplished by, for example, the use of a register pin that will drop from above into the gap between adjacent cards and which will push the card from behind and will forward it on synchronously with the speed of the conveyor belts of the feed device 6 and the circumferential speed of the printing unit. As will be discussed in detail shortly, the printing unit includes a rubber blanket support cylinder 19 which cooperates with a rubber covered counter-pressure cylinder 23 to form a printing nip into which each plastic card 2 to be printed is fed by the slides of the feed device 6. The card 2 to be printed is properly spaced or longitudinally registered by the indexing feed device 6 and the conveyor belt 10. It is also properly spaced or laterally registered by maintaining at least one of the side edges of the card 2 parallel to the transporting device through the use of a suitable lateral registration device that is not specifically shown in the drawings.

Viewed in the production direction, which is from right to left as seen in FIG. 1, the printing and inking unit 7 is subsequent, in the direction of travel of the cards 2, to the indexing feed device 6. The printing and inking unit is equipped for planographic printing, without the use of a dampening agent. The printing unit 7 is also equipped for use with so-called UV printing inks and, in accordance with the present invention does not have any device for setting the printing ink thickness over the width of a color zone. In the printing unit 7, and viewed in the direction of the ink travel or flow, the printing ink is supplied from an ink duct or chamber 14 to a screen surface cylinder 16 and from the screen cylinder 16 to an ink transfer cylinder 17 that has an ink accepting or ink friendly surface. The ink transfer cylinder 17 supplies the UV ink to a printing forme support cylinder 18 which carries one or more printing plates or formes that are adapted for printing without dampening agents. So-called Toray printing plates or formes may be used in the apparatus. The printing forme support cylinder 18 engages a rubber blanket support cylinder 19 which carries an offset rubber blanket. These several cylinders 16–19, as well as the ink duct 14 are supported between spaced left and right side walls, 12 and 13 respectfully of a pivotable frame 24. A suitable working doctor blade, which is not shown in the drawings, is set negatively against the screen cylinder 16. In the ready-to-print state of the present invention, the cylinders 16–19 preferably all have the same diameter. The screen cylinder 16 can also have a diameter which is either twice the diameter of the other cylinders or alternatively one-half of the diameter of the other cylinders.

As may also be seen in FIG. 1, the counter-pressure cylinder 23, which cooperates with a rubber blanket support cylinder 19 to print each plastic card 2, is supported for rotation about a generally horizontal axis of rotation that is transverse to the direction of travel of the cards 2, between spaced lower side frames 21 and 22. The counter-pressure cylinder 23 is disposed directly beneath the rubber blanket support cylinder 19 and forms the printing gap with the rubber blanket support cylinder 19. The printing gap spacing can be adjusted by bring the two cylinders 19 and 23 closer to each other or by moving them apart. This can be accomplished by supporting the two cylinder journals of the counter-pressure cylinder 23 in adjustable eccentric bushings which are seated in bores in the spaced lower side frames 21 and 22. The counter-pressure cylinder 23 has the same diameter as the rubber blanket support cylinder 19 and is covered by a rubber blanket which can be, for example, glued on.

Figure 2:
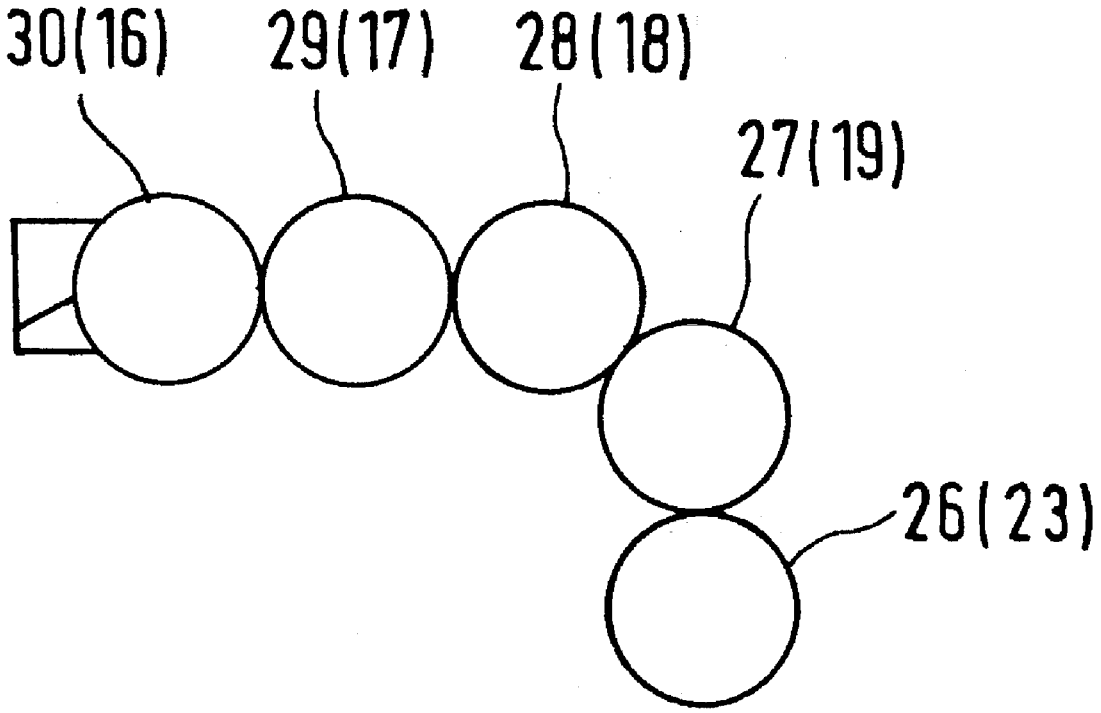
FIG. 2 is a schematic depiction of the gear drive mechanism for the present invention.

The counter-pressure cylinder 23 is driven by a suitable electric drive motor 20 through a toothed belt 25. The counter-pressure cylinder 23 has a gear wheel 26 on one of its ends. As is schematically depicted in FIG. 2, this counter-pressure cylinder gear wheel 26 is in engagement with a gear wheel 27 on the blanket cylinder 19. A gear wheel 28 on the printing forms support cylinder 18 engages the blanket cylinder gear 27 and also engages a gear wheel 29 on the ink transfer cylinder 17. This ink transfer cylinder gear wheel 29 is in engagement with a gear wheel 30 on the screen cylinder 16. It will be understood that each gear wheel 26–30 has the same diameter and the same number of gear teeth so that all of the cylinders 16–19 and 23 will rotate at the same circumferential speed. These gears 26–30 thus constitute a gear wheel drive train for the printing and inking unit 7. If the diameter of the screen cylinder 16 is different from that of the several other cylinders 17–19 and 23, the size of the screen cylinder gear wheel 30 will be appropriately adapted so that the circumferential speed of the screen cylinder 16 will remain the same as the circumferential speeds of the cylinders 17–19 and 23.

As was discussed previously, a working doctor blade, which is not specifically shown in the drawings, is set negatively against the screen cylinder 16 and returns excess ink from the screen cylinder 16 back to the ink duct 14. The ink duct 14 itself is a box that is closed on three sides and its ends and has an open upper area into which the surface of the screen cylinder 15 is immersed. The ink duct 14 receives a suitable UV ink and applies it to the screen cylinder 16. The working doctor blade adjoins the ink duct 14 generally at the bottom of the screen cylinder 16 and operates to maintain an even distribution of ink over the entire length of the screen cylinder 16 or over the appropriate partial length of the screen cylinder 16 in case several parallel streams of cards 2 are being printed and the screen cylinder 16 is thus provided with several partial length ink ducts 14, each having a separate supply of a suitable UV ink.

In operation, each of the plastic cards 2 to be printed, is pushed by the feed device 6 into the printing gap between the rubber blanket support cylinder 19 and the counter-pressure cylinder 23. The cards are printed on one side with the ink image from the rubber blanket on the cylinder 19 and are conveyed in an essentially slip-free manner by the rubber blanket support cylinder 19 and the rubber covered counter-pressure cylinder 23. As discussed above, the UV ink applied to the plastic cards 2 from the rubber blanket support cylinder 19 is received from the printing forme support cylinder 18 which was provided with ink from the rubber-coated ink transfer cylinder 17 that received its ink from the screen cylinder 16. This ink is provided from a supply of UV printing ink in the ink duct 14 and its thickness is controlled by the working doctor blade that is placed adjacent to screen cylinder 16. Once the card 2 has been printed, it exits the printing gap as a printed card 9 and is placed in a conveying device 8 that directly adjoins the printing gap and which consists of a driven conveyor belt. The speed of the travel of the conveying device 8 and the printing speed are the same. The printed plastic cards 9 are conveyed by the conveying device 8 through a suitable UV dryer, generally at 11, and along to a suitable exit stacking installation for the cards 9, which is not specifically shown in the drawings.

As may also be seen in FIG. 1, the speed or R.P.M.-controlled drive motor 20 for the counter-pressure cylinder 23 drives cylinder 23 through a suitable toothed drive belt 25. A first end of a crank mechanism, generally at 31, is connected to an end face of the counter-pressure cylinder 23 or to its gear wheel 26. A second end of the crank mechanism 31 is in engagement with the indexing feed device 6. This crank mechanism 31 thus coordinates the speed of the indexing feed device 6 with the rotational speed of the counter-pressure cylinder 23 and hence with the speed of the printing and inking unit 7.

Again, referring to FIG. 1, the two spaced upper side walls 12 and 13 are connected by use of several transverse struts to form a pivotable frame 24 which carries the inking and printing unit 7. This pivotable frame 24 is connected with the upper portion of the two lower side frames 22 and 23 by suitable hinges 32. The hinges 32 are located on the ends of the upper side walls 12 and 13 which are remote from the rubber blanket support cylinder 19. This means that when the printing and inking unit pivot frame 24 is pivoted up and away from the two lower side frames 21 and 22 about the hinges 32 the rubber blanket support cylinder 19 will move up and out of engagement with the counter-pressure cylinder 23. The travel distance of the pivot frame 24 is sufficient to afford adequate access to both the blanket cylinder 19 and to the counter-pressure cylinder 23 so that their respective rubber blankets or covers, which are typically glued on, can be removed and replaced when necessary. The pivot frame 24 can be held in its open pivoted-away position by, for example, gas pressure springs or struts which are attached to the lower side frames 21 and 22. During printing, the pivot frame 24 rests flat on the side frames 21 and 22 and is securely connected to these lower side frames by suitable screws or the like.

It is possible, in accordance with the present invention, to feed a plurality of separate, parallel streams of unprinted plastic cards 2 to the printing device. These several streams of cards 2 can be printed simultaneously by use of suitable cylinders 16–19 and 23 which are multiple cards wide. In such a situation, it is obviously necessary to supply a corresponding number of separating devices 3, feeding devices 6, circumferential register devices, and lateral register devices. Since it is also possible to print various different designs in different color on cards in adjacent stream, it is then necessary that an individual ink duct 14 be used for each of the several streams of plastic cards 2 to be printed. It would also be possible, in accordance with the present invention to position several printing units one behind the other so that an individual card could be printed in multiple colors by the several printing unit.

It would be possible, in accordance with the present invention, to support the ink transfer cylinder 17 in a rotatable manner on a fixed shaft and to eliminate the ink transfer cylinder gear 29. In this arrangement, the ink transfer cylinder gear 29. In this arrangement, the ink transfer cylinder would be driven by frictional contact with the screen cylinder 16 and the printing frame support cylinder 19. In this arrangement, it will also be understood that the screen cylinder 16 would be provided with its own drive source.

While a preferred embodiment of a printing device for printing plastic cards in accordance with the present invention has been set forth fully and completely, hereinabove, it will be apparent to one of skill in the art that a number of changes in, for example, the overall sizes of the various cylinders, the type of electrical drive motor used, the structure of the printed card conveying device, and the like could be made without departing from the true spirit and scope of the present invention which is accordingly to be limited only by the following claims.

What is claimed:

1. A printing device for printing individual plastic cards of a check card format comprising:

a counter-pressure cylinder having a rubber blanket and supported for rotation between spaced first and second lower side frames;

an upper pivot frame supported for pivotal movement about a first end on said first and second lower side frames;

a printing and inking unit including an ink duct, a screen cylinder receiving ink from said ink duct, an ink transfer cylinder in contact with said screen cylinder, a printing forme support cylinder in contact with said ink transfer cylinder, and a rubber blanket support cylinder in engagement with said printing forme support cylinder, said printing and inking unit being supported by said upper pivot frame with said rubber blanket support cylinder being engageable with said counter-pressure cylinder to form a printing gap for printing said plastic cards; and means for driving said counter-pressure cylinder and said cylinders in said inking and printing unit in a synchronous manner with respect to each other.

2. The printing device in accordance with claim 1 wherein each of said cylinders carries a gear wheel, wherein said cylinder gear wheels form a gear wheel train and further wherein said gear wheel train is provided with power from said gear wheel carried by said counter-pressure cylinder.

3. The printing device of claim 1 wherein said printing forme support cylinder, said rubber blanket support cylinder, and said screen cylinder are commonly driven and further wherein said ink transfer cylinder is driven by frictional contact with said screen cylinder and said printing forme support cylinder.

4. The printing device of claim 1 wherein the diameters of all of said cylinders are the same in the ready-to-print state.

5. The printing device of claim 1 wherein said printing form support cylinder has a first diameter and said screen cylinder has a second diameter.

6. The printing device of claim 5 wherein said first and second diameter are equal.

7. The printing device of claim 5 wherein said second diameter is one-half of said first diameter.

8. The printing device of claim 5 wherein said second diameter is twice said first diameter.

9. The printing device of claim 1 further including means for feeding a stream of plastic cards to said printing gap.

10. The printing device of claim 1 further including means for feeding a plurality of parallel spaced streams of plastic cards to said printing gap.

11. The printing device of claim 1 further including an indexing card feeder, said indexing card feeder being connected to said counter-pressure cylinder by a crank assembly.

* * * * *